US005098446A

United States Patent [19]

Rodriguez et al.

[11] Patent Number: 5,098,446

[45] Date of Patent: Mar. 24, 1992

[54] USE OF FLUOROCHEMICALS IN LEATHER MANUFACTURE

[75] Inventors: L. M. B. Rodriguez; Claudio M. Martinez, both of Madrid, Spain

[73] Assignee: Minnesota Mining and Manufacturing Company, St. Paul, Minn.

[21] Appl. No.: 420,874

[22] Filed: Oct. 13, 1989

[51] Int. Cl.[5] ..... C14C 3/02; C14C 3/04; D06P 3/32

[52] U.S. Cl. ..... 8/94.26; 8/94.1 R; 8/94.2; 8/94.25; 8/94.27; 8/94.29; 8/436

[58] Field of Search ..... 8/94.23, 94.15, 94.21, 8/94.2, 94.1 R; 252/8.57, 8.9, 395, 406

[56] References Cited

U.S. PATENT DOCUMENTS 3,562,156 2/1971 Francen ..... 252/8.05
3,772,195 11/1973 Francen ..... 252/8.05
3,787,351 1/1974 Olson ..... 260/40 R
3,825,577 7/1974 Lalu et al. ..... 260/435 R
4,359,096 11/1982 Berger ..... 169/44
4,484,990 11/1984 Bultman et al. ..... 204/106
4,539,006 9/1985 Langford ..... 8/94.1
4,564,366 1/1986 Patel ..... 8/94.1 R
4,668,406 5/1987 Chang ..... 252/8.75
4,795,764 1/1989 Alm et al. ..... 521/107
4,971,835 11/1990 Munch ..... 427/421

*Primary Examiner*—Prince Willis, Jr.
*Assistant Examiner*—John F. McNally
*Attorney, Agent, or Firm*—Gary L. Griswold; Walter N. Kirn; Carole Truesdale

[57] ABSTRACT

Leather manufacturing processes are described in which fluorochemicals are included in the various processing baths to improve efficiency, reduce processing time, and increase the quality of the finished leather product. Various types of fluorochemicals are described for use in the processing techniques.

12 Claims, No Drawings

USE OF FLUOROCHEMICALS IN LEATHER MANUFACTURE

FIELD OF THE INVENTION

This invention relates to leather manufacture. More particularly, this invention relates to leather manufacturing techniques. In another aspect this invention relates to the use of fluorochemicals in leather manufacturing processes.

BACKGROUND OF THE INVENTION

Leather has enjoyed widespread popularity and usage for centuries. It has been, and currently is, widely used for footwear, garments of various types, luggage, upholstery, sporting goods, and a variety of other products and goods.

Leather is produced from animal hides or pelts which are composed primarily of a three dimensional network of protein fibers. The proteins include collagen, keratin, elastin, and reticulin. Collagen is the leathermaking protein of the hide. Collagen is responsible for the great strength and toughness of the hide and of the leather produced from the hide.

The hide of animals is composed of an interwoven fibrous mat, a thin cellular outer layer supporting hair, and a fatty layer which attaches to the underlying muscles of the animal. The outer layer is normally referred to as the grain layer. The corium layer is beneath the grain layer and is composed primarily of bundles of collagen fibers which are interwoven in a random three dimensional pattern.

Many separate steps are involved in the processing of hides to produce useful leather for the production of sundry types of goods and garments. The hides may be provided to the tannery in a brine-cured condition. The curing dehydrates the hide. After the salt has been removed, the fibers are rehydrated by soaking. A detergent may be added to speed the hydration. Soaking removes water-soluble protein and cleans the hide. Even if the hides are not brine-cured prior to delivery to the tannery, it is still necessary to soak the hides when they are received.

Then the hair (keratin) can be removed using a saturated solution of calcium hydroxide (lime) by itself or in combination with sodium sulfide or sodium sulfhydrate. The lime loosens the hair for easy removal. Hair can also be removed by dissolving it with sulfide at high pH. If desired, the hair (e.g., wool) may be left on the hide and not removed.

The hide may be soaked in fresh lime solution to open up the collagen fiber structure and remove additional proteins. This allows better penetration of tanning chemicals.

Then the hide is ready for deliming (if a liming step has been used), bating and pickling to prepare the hide for tanning. Limed hide has a high pH (e.g., about 12). The hide is washed in water to remove soluble lime and loose hair particles. Ammonium sulfate is commonly used as a deliming salt.

Following the deliming step, if used, the hide is subjected to bating, which is the use of enzymes to break down miscellaneous proteins in the hide. Detergents may be added to assist in fat removal. After bating, the hide is pickled with sulfuric acid to lower the pH. The hide must be in an acid condition for the tanning operation.

The tanning operation involves the treatment of the hide to preserve it and form useful leather. Chrome tanning salts are well known and widely used for this purpose. Chrome sulfate in particular is a common salt used in tanning. Other types of tanning agents can also be used, if desired, such as vegetable tanning agents (i.e., polyphenolic compounds), mineral tanning agents (i.e., zirconium, aluminum, iron, silica), resin tanning agents, oil tanning, sulfonyl chloride, or aldehydes (i.e., formaldehyde and glutaraldehyde).

After the hide has been tanned, it may be retanned, dyed and fatliquored. Retanning procedures allow subsequently applied dye to better penetrate the leather. Fatliquoring is the application of oil-in-water emulsions to the leather. It may be done simultaneously with the dyeing process. Surfactants are normally used in such emulsions. The fatliquoring process is for the purpose of putting oil into the hide to lubricate the fibers. This improves the appearance and also the physical properties of the leather.

After fatliquoring, the leather can be dried. This involves the removal of excess water and completes the reactions of some of the materials used to treat the leather.

Thus, many steps and processing techniques are required to convert natural animal hides or pelts into the desired leather products. Each of the various steps involves a considerable amount of time and specialized treating baths.

Because of the great popularity and demand for high quality leather products, the processing of the hides and pelts must be performed carefully and efficiently in order to produce the best quality leather possible. Consequently, there is always a desire to speed the processing and to increase the quality in the resulting product.

SUMMARY OF THE INVENTION

In accordance with the present invention there are provided improved techniques for the processing of hides and pelts in leather manufacturing. More particularly, the present invention provides improved processing techniques in which fluorochemicals are included in one or more of the various processing baths used in leather manufacturing.

A shortening of the required processing time is obtained in accordance with the present invention when a fluorochemical is included in the processing bath. Improved results are obtained in each of the various processes involved in converting raw animal hides or pelts into finished leather. In addition to lessening the required processing times, the inclusion of a fluorochemical in the processing baths results in an increase in surface area of the finished leather, a decrease in leather weight, and an improvement in quality of the finished leather.

Inclusion of such fluorochemical in the tanning bath results in better exhaustion of the bath, an increase in the pH of the leather, and also an increase in water retention of the leather. The drying time for the leather is also reduced.

Fluorochemicals which are useful in the present invention can be compounds, oligomers, or polymers.

Other advantages of the processing techniques of the present invention will be apparent from the following detailed description.

DETAILED DESCRIPTION OF THE INVENTION

The techniques of the present invention are applicable to each of the various processing steps used in the treatment of animal hides and pelts. For the purposes of this invention, the term "hides" is intended to refer to and include both hides and pelts which have been removed from all types of animals, e.g., bovine, ovine, caprine, swine, etc. The various processing steps may include soaking steps, dehairing, liming, deliming, bating, pickling, degreasing, tanning, retanning, dyeing and fixation steps, and fatliquoring processing.

Fluorochemicals which are useful in the techniques of this invention include compounds, oligomers, and polymers. For convenience sake, they are generally referred to herein as fluorochemicals, fluorochemical agents or fluorochemical processing aids. Such materials will contain at least about 10% by weight of fluorine, i.e. carbon-bonded fluorine. They contain one or more fluorinated aliphatic radicals ($R_f$), sometimes referred to as fluoroaliphatic radicals, and one or more water-solubilizing polar groups (Z), which radicals and groups are usually connected together by suitable linking groups (Q).

The fluoroaliphatic radical, $R_f$, in the agent can be generally described as a fluorinated, preferably saturated, monovalent, non-aromatic radical of at least 3 carbon atoms. The aliphatic chain may be straight, branched, or, if sufficiently large, cyclic and may include oxygen, hexavalent sulfur, or trivalent nitrogen atoms bonded only to carbon atoms. A fully fluorinated radical is preferred, but hydrogen or chlorine atoms may be present as substituents provided that not more than one atom of either is present for every two carbon atoms. While radicals containing a larger number of carbon atoms will function adequately, compounds containing not more than about 20 carbon atoms are preferred since larger radicals usually represent a less efficient utilization of fluorine than is possible with shorter chains. Fluoroaliphatic radicals containing about 5 to 12 carbon atoms are most preferred.

The water-solubilizing polar group or moiety, Z, of the fluorochemical agent can be an anionic, cationic, non-ionic or amphoteric moiety, or combinations of said groups or moieties which may be the same or different. Typical anionic groups include $CO_2H$, $CO_2M$, $SO_3H$, $SO_3M$, $OSO_3H$, $OSO_3M$, $OPO(OH)_2$, and $OPO(OM)_2$, where M is a metallic ion (such as sodium, potassium, etc.), or ammonium ion, or other amine cation. Typical cationic groups include $NH_2$, NHR, $NR_2$, where R is a lower alkyl group such as methyl, ethyl or butyl, $NR'_3A'$, where R' is a lower alkyl group or hydrogen and A' is an anion such as chloride, sulphate, phosphate, hydroxyl, etc. Typical non-ionic groups would include $NR_2 \rightarrow O$ and poly(oxyalkylene) moieties, e.g., those derived from polyethylene oxide, polypropylene oxide and mixed polyethylene oxide-polypropylene oxide polyols. Typical mixed or amphoteric groups would include $N^+(CH_3)_2C_2H_4COO^-$.

The linking group, Q is a multivalent, generally divalent, linking group such as alkylene, arylene, sulfonamidoalkylene, carbonamidoalkylene, and other heteroatom-containing groups such as siloxane, and the like, including combinations of such groups. In some instances more than one fluoroaliphatic radical may be attached to a single linking group and in other instances a single fluoroaliphatic radical may be linked by a single linking group to more than one polar solubilizing group. Q can also be a covalent bond.

A particularly useful class of fluorochemical agents which can be used in this invention are those of the formula $$(R_f)_nQ_aZ \qquad \text{I}$$

where $R_f$ is said fluoroaliphatic radical, n is 1 or 2, Q is said linking group, a is zero or and Z is said water-solubilizing group.

Fluorochemical compounds useful as fluorochemical agents or processing aids in this invention, include anionic compounds, for example, fluorinated organic acids, e.g., $R_fSO_3H$ and $R_fCO_2H$, and salts thereof, and cationic compounds, for example, amines, e.g., $R_fSO_2NHC_3H_6N(CH_3)_2$, and salts thereof, and also include fluorinated organic compounds containing one or more acid groups and one or more amine groups, i.e., amphoteric compounds, and salts thereof, including internal salts, e.g., $R_fCONHC_3H_6N^+(CH_3)_2C_2H_4COO^-$. Said fluorochemical compounds also include non-ionic oxyalkylene compounds, which can be derivatives, for example, of active hydrogen-containing fluorochemical intermediates, e.g., fluorochemical alcohols, e.g., $R_fC_2H_4OH$, acids, e.g., $R_fSO_2N(R')CH_2CO_2H$, and sulfonamides, e.g., $R_fSO_2N(R')H$, prepared by reaction of said intermediates with ethylene oxide to yield, respectively, $R_fC_2H_4O(C_2H_4O)_nH$, $R_fSO_2N(R')CH_2CO_2(C_2H_4O)_nH$, and $R_fSO_2N(R')(C_2H_4O)_nH$, where n is a number greater than about 3, and R' is hydrogen or lower alkyl (e.g., 1 to 6 carbons).

Representative anionic fluorochemicals useful in this invention include:

$C_8F_{17}SO_3K$
$C_8F_{17}SO_2NHCH_2C_6H_4SO_3Na$
$C_8F_{17}SO_2NHC_6H_4SO_3H$
$C_8F_{17}C_2H_4SC_2H_4CONHC(CH_3)_2CH_2SO_3Na$
$C_8F_{17}SO_2N(C_2H_5)C_2H_4OP(O)(OH)_2$
$(CF_3)_2CF(CF_2)_6COOH \cdot H_2NC_2H_5$
$C_8F_{17}SO_2N(C_2H_5)CH_2CO_2K$
$C_{10}F_{19}OC_6H_4SO_3Na$
$(CF_3)_2CF(CF_2)_4CONHC_2H_4SO_3Na$
$C_7F_{15}COOH \cdot H_2NCH_2COOH$
$C_8F_{17}C_2H_4OSO_3H$
$C_{10}F_{21}SO_3NH_4$
$C_7F_{15}COONH_4$
$(C_6F_{13}C_2H_4S)_2C(CH_3)C_2H_4COOH$
$C_8F_{17}C_2H_4SO_2CH_2COONa$
$C_6F_{13}C_2H_4COONa$ Fluorochemical agents of the foregoing type are described, for example, in U.S. Pat. Nos. 4,795,764; 3,562,156; 3,772,195; and 4,359,096; all of which are incorporated herein by reference.

Useful non-ionic fluorochemicals include, for example, the following compounds:

$C_8F_{17}SO_2N(C_2H_5)CH_2CO_2(C_2H_4O)_{15}H$
$C_8F_{17}SO_2N(C_2H_5)C_2H_4O(C_2H_4O)_{13}H$
$C_8F_{17}C_2H_4O(C_2H_4O)_{15}H$

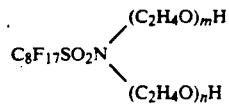

(m + n = 25)

$C_8F_{17}SO_2N(C_2H_5)C_2H_4O(C_3H_6O)_8H$
$C_8F_{17}C_2H_4SCHCO_2(C_3H_6O)_mH$ $CH_2CO_2(C_3H_6O)_nH$ (m+n=20)

Compounds of the foregoing type are described, for example, in U.S. Pat. No. 4,668,406, incorporated herein by reference.

Useful cationic fluorochemicals include, for example, the following compounds:

$C_6F_{13}SO_2NHC_3H_6N^+(CH_3)_3Cl^-$ $C_8F_{17}SO_2NHC_3H_6N^+(CH_3)_3{-}O_3SOCH_3$ $C_8F_{17}C_2H_4SC_2H_4CONHC_2H_4N^+(CH_3)_3Cl^-$ $C_6F_{13}SO_2NHC_3H_6N^+(CH_3)_2C_2H_4OH\ OH^-$ $C_6F_{13}SO_2N(CH_2CH_2OH)C_3H_5N^+(CH_3)_2C_2H_4OH\ OH^-$ $C_8F_{17}SO_2NHCH_2CH_2CH_2N^+(CH_3)_3\ I^-$ $C_8F_{17}SO_2NHCH_2CH_2CH_2N^+(CH_3)_3\ Cl^-$ $C_6F_{13}SO_2NHC_3H_6N(CH_3)_2$ $C_6F_{13}SO_2NHC_3H_6N(CH_3)_2{\rightarrow}O$ $C_6F_{13}C_2H_4SO_2NHC_3H_6N^+(CH_3)_3\ OH^-$ $C_8F_{17}C_2H_4N^+(CH_3)_2C_2H_4OH\ OH^-$

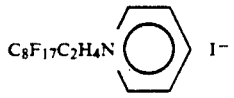

$C_{10}F_{19}OC_6H_4SO_2NHC_3H_6N(CH_3)_2$ $(CF_3)_2CFOC_2F_4CONHC_3H_6NH_2$

Compounds of the foregoing type are described, for example, in U.S. Pat. No. 4,795,764 and 4,484,990, incorporated herein by reference.

Useful amphoteric fluorochemicals include, for example, the following compounds:

$C_6F_{13}SO_2N(CH_2CHOHCH_2SO_3^-)C_3H_6N^+(CH_3)_2C_2H_4OH$ $C_6F_{13}SO_2N(C_3H_6SO_3^-)C_3H_6N^+(CH_3)_2C_2H_4OH$ $C_7F_{15}CONHC_3H_6N^+(CH_3)_2C_2H_4COO^-$ $C_6F_{13}C_2H_4SO_2N(CH_3)C_2H_4N^+(CH_3)_2C_2H_4COO^-$ $C_6F_{13}SO_2NHC_3H_6N^+(CH_3)_2CH_2CH_2COO^-$ $C_8F_{17}SO_2NHC_3H_6N(CH_3)C_3H_6SO_3Na$ $C_8F_{17}SO_2NHC_3H_6N(C_2H_4OH)C_3H_6SO_3Na$ $C_7F_{15}CONHC_3H_6N(CH_3)C_3H_6SO_3Na$ $C_6F_{13}SO_2N(C_2H_5)C_3H_6NHCH_2CH(OH)CH_2SO_3Na$ $C_4F_9SO_2NHC_3H_6N^+(CH_3)_2CH_2COO^-$ $C_6F_{13}C_2H_4SC_2H_4N^+(CH_3)_2CH_2COO^-$ $C_6F_{13}SO_2NHC_3H_6N^+(CH_3)_2C_3H_6SO_3^-$ $C_6F_{13}SO_2N(CH_2COONa)C_3H_6N^+(CH_3)_3\ OH^-$ $C_6F_{13}SO_2N(C_2H_4COONa)C_3H_6N^+(CH_3)_2C_2H_4COO^-$ $C_8F_{17}CH_2CH(COO^-)N^+(CH_3)_3$ $(CF_3)_2CFOC_3F_6CONHC_2H_4N^+(CH_3)_2C_2H_4COO^-$ $C_{10}F_{19}OC_6H_4SO_2N(CH_2COONa)C_3H_6N(CH_3)_2$

Compounds of the foregoing type are described, for example, in U.S. Pat. Nos. 4,795,764 and 4,484,990, incorporated herein by reference.

Fluorochemical oligomers and polymers, hereinafter referred to as oligomers, useful as fluorochemical agents or processing aids in this invention, have a plurality of pendant fluoroaliphatic groups, $R_f$, linked to water-solubilizing moieties selected from anionic, cationic, nonionic and amphoteric moieties, and compatible combinations of such moieties. Such moieties are preferably poly(oxyalkylene) moieties. These fluorochemical oligomers are generally non-ionic, normally liquid or low-melting solids. They have about 5 to 40 weight percent, preferably about 10 to 30 weight percent carbon-bonded fluorine, based on the weight of oligomer, the fluorine content residing in said plurality of pendant fluoroaliphatic radicals. These materials are relatively low molecular weight linear polymers, or lightly cross-linked polymers, containing from 3 to 4 up to about 25 or 30 monomer units, and thus are oligomeric, as contrasted to "high polymers" having a molecular weight of 100,000 or higher.

A class of fluorochemical oligomers containing poly(oxyalkylene) moieties useful in this invention can be represented by the formulas $$(R_f)_mQ'[(R'')_xQ''Y]_p \qquad \text{II}$$

and $$[(R_f)_mQ'[(R'')_xQ''Y']_p]_t \qquad \text{III}$$

where $R_f$ is a fluoroaliphatic radical as defined above,

Q' is a linkage through which $R_f$ and R'' are covalently bonded together,

R'' is an oxyalkylene group selected from $-OC_2H_4-$ and $-OC_3H_6-$ radicals,

Y is a monovalent terminal organic radical,

Y' is Y or a valence bond, with the proviso that at least one Y' is a valence bond interconnecting a Q'-bonded R'' radical to another Q', Q'' is a linkage through which Y or Y' and R'' are covalently bonded together, m is a number of at least 2 and can be as high as 10 or higher, x is a number of at least 5, generally 10 to 75, and can be as high as 100 or higher, p is a number of at least 2 and can be as high as 60 or higher, and t is a number of 2 or higher and can be as high as 30 or higher.

Particularly useful classes of poly(oxyalkylene)-containing fluorochemical oligomers falling under the above general formulas II and III are polyacrylates.

Examples of this class of fluorochemical agents can be prepared by copolymerizing any of the fluorochemical acrylates of Table 1 with any of the compounds of Table 2.

TABLE 1

1. $C_8F_{17}SO_2N(CH_3)CH_2OCOCH{=}CH_2$
2. $C_6F_{13}C_2H_4OCOC(CH_3){=}CH_2$
3. $C_6F_{13}C_2H_4SC_2H_4OCOCH{=}CH_2$
4. $C_8F_{17}C_2H_4OCOC(CH_3){=}CH_2$
5. $C_8F_{17}C_2H_4N(CH_3)C_2H_4OCOC(CH_3){=}CH_2$
6. $C_2F_5C_6F_{10}CH_2OCOCH{=}CH_2$
7. $C_7F_{15}CH_2OCOCH{=}CH_2$
8. $C_7F_{15}CON(CH_3)C_2H_4OCOCH{=}CH_2$
9. $(CF_3)_2CF(CF_2)_6CH_2CH(OH)CH_2OCOCH{=}CH_2$
10. $(CF_3)_2CFOC_2F_4C_2H_4OCOCH{=}CH_2$
11. $C_8F_{17}C_2H_4SO_2N(C_3H_7)C_2H_4OCOCH{=}CH_2$
12. $C_7F_{15}C_2H_4CONHC_4H_8OCOCH{=}CH_2$
13. $C_3F_7(CFCF_2O)_2CFCH_2OCOCH{=}CH_2$ ($CF_3$, $CF_3$)
14. $C_7F_{15}COOCH_2C(CH_3)_2CH_2OCOC(CH_3){=}CH_2$
15. $C_8F_{17}SO_2N(C_2H_5)C_4H_8OCOCH{=}CH_2$
16. $(C_3F_7)_2C_6H_3SO_2N(CH_3)C_2H_4OCOCH{=}CH_2$
17. 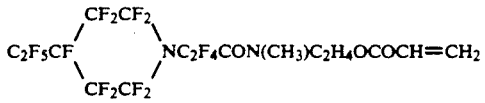
18. $C_6F_{13}CF{=}CHCH_2N(CH_3)C_2H_4OCOCH{=}CH_2$
19. $C_8F_{17}SO_2N(C_4H_9)C_2H_4OCOCH{=}CH_2$
20. $C_8F_{17}SO_2N(C_2H_5)C_2H_4OCOC(CH_3){=}CH_2$

TABLE 2

1. $CH_2{=}CHCO_2(C_2H_4O)_{10}(C_3H_6O)_{22}(C_2H_4O)_{10}COCH{=}CH_2$

TABLE 2-continued

| | |
|---|---|
| 2. | $CH_2{=}CHCO_2(C_2H_4O)_{17}CH_3$ |
| 3. | $CH_2{=}C(CH_3)CONH(C_3H_6O)_{44}H$ |
| 4. | $CH_2{=}C(CH_3)CO_2(C_2H_4O)_{90}COC(CH_3){=}CH_2$ |
| 5. | $HS(C_2H_4O)_{23}(C_3H_6O)_{35}(C_2H_4O)_{22}C_2H_4SH$ |

Oligomers and polymers of these types are described for example, in U.S. Pat. Nos. 4,668,406 and 3,787,351, both of which are incorporated herein by reference.

Compatible mixtures of the above defined fluorochemical agents, including compounds, oligomers and polymers, can also be used in the processes of this invention.

In the present invention it has been found that the addition of a small amount of fluorochemical to the processing baths results in improved quality of the leather product. It has also been found that the addition of a small amount of fluorochemical to certain of the processing baths significantly reduces the time required for processing. The amount of fluorochemical added may vary, e.g., upwards from about 0.01 gram per liter (0.001 percent by weight) of aqueous processing bath. Preferably the amount of fluorochemical used is at least about 0.003 percent by weight.

Hides are normally received by the tannery from the slaughterhouse in a salt-cured or brine-cured condition. Because the curing dehydrates the hide, it is necessary to soak the hide in water to remove the salt and rehydrate the fibers in the hide. A conventional hydrocarbon surfactant is normally included in the soak bath. Soaking may require several hours. Even if the hides are not cured before delivery to the tannery, it is still necessary to soak the hides.

The types of fluorochemicals which may be used in the soaking bath preferably are anionic or nonionic materials.

It has also been found that the addition of a fluorochemical to the bating and pickling baths results in more efficient processing of hide. The time required for processing is reduced, and more efficient breakdown of the proteins in the hide is observed. In the pickling process, use of a fluorochemical results in a more homogeneous decrease in the pH of the hide.

It has further been found that degreasing of hides can be made more effective and efficient by including in the bath a fluorochemical agent. Addition of fluorochemical agents to the degreasing bath assists in removal of fat from the hide. As a result, more fat is removed in the degreasing bath than is removed without use of the fluorochemical.

Addition of fluorochemicals to tanning baths has also been found to improve the efficiency of the tanning procedure. Inclusion of a fluorochemical in the tanning bath has been found to reduce the amount of tanning salts required for desired tanning. The tanning process is also more rapid, and more homogeneous tanning is obtained through the hide thickness. The tanning bath is also more completely exhausted of tanning salts (due to the increased efficiency of the process), which results in less contaminated wastewater.

The inclusion of the fluorochemical also results in an increase in the pH of the leather (e.g., by one pH unit or more). This is very desirable because it enables later applied chemicals to penetrate the hide more readily.

It has also been found that the inclusion of a fluorochemical in the neutralizing bath is beneficial in raising the pH of the leather to a higher level than is obtained normally. This also enables later-applied chemicals to penetrate the hide more readily.

The inclusion of fluorochemicals in the fatliquoring bath has also been found to be beneficial in enabling the oils to penetrate the leather. As a result, the leather performs better in the subsequent mechanical works (i.e., stretching, buffing, etc.) with less risk of damage to the leather.

Another advantage observed with the inclusion of fluorochemicals in the fatliquoring process is that there is highly increased water retention in the leather and a shorter drying time required. The increased water retention is important because it enables the leather to be stored longer without risk of loss.

It has also been found that fixation of dyes in the leather can be improved by including a fluorochemical agent in the bath. Inclusion of fluorochemical in the bath reduces the amount of time required for fixation of the dyes. It also results in better utilization of the other chemicals in the bath, and it also results in less contaminated waste water.

The invention is further illustrated by means of the following examples where the term "parts" refer to parts by weight unless otherwise indicated.

EXAMPLE 1

Wool-on sheepskin pelts are subject to initial soaking in conventional manner (as a control) and in baths containing different types of amounts of fluorochemical agents.

The conventional soaking bath contains one kilogram of pelts for each 14 kilograms of water (at 35° C.). A conventional hydrocarbon surfactant is included at a concentration of 0.48 gram per liter of water. The soaking proceeds for three hours while the bath is agitated.

Another soak bath included the same items as the control bath but further included 0.14 gram per liter of an anionic fluorochemical agent having the formula $C_8F_{17}SO_3K$. This agent was first diluted in water (1:10), then added to the conventional surfactant, and then added to the soak bath 20 minutes later. After approximately two hours, the pelts achieved the same condition as the control batch.

Another soak bath included the same items of the control bath but further included 0.11 gram per liter of a nonionic fluorochemical agent having the formula $$C_8F_{17}SO_2\overset{\overset{\displaystyle C_2H_5}{|}}{N}{-}C_2H_4(OC_2H_4)_{13}OH$$

This compound (95% by weight solution in water) was diluted in water (1:10), then added to the conventional surfactant, and then added to the soak bath 20 minutes later. After approximately two hours the pelts achieved the same condition as the control batch.

Another soak bath included the same items as the control bath but further included 0.22 gram per liter of an oligomeric nonionic fluorochemical agent which is a 30:70 copolymer of $$C_8F_{17}SO_2\overset{\overset{\displaystyle C_4H_9}{|}}{N}{-}C_2H_4OCOCH{=}CH_2$$

and acrylic acid ester (about 60% esterified) of $HO(C_2H_4O)_{10}(C_3H_6O)_{22}(C_2H_4O)_{10}H$.

The agent was diluted in water (1:10), added to the conventional surfactant, and then added to the soak bath 20 minutes later. The soak time required for the pelts to achieve the same condition as the control batch was about 25% of the control batch.

EXAMPLE 2

Wool-on sheepskin pelts are soaked a second time. A control batch includes one kilogram of pelts for each 14 kilograms of water (25°-30° C.). A conventional hydrocarbon surfactant (0.06 gram per liter), a fungicide (0.25 gram per liter) and sodium chloride (23 grams per liter) are also included in the bath. The bath is stirred for 30 minutes and then allowed to stand overnight.

Comparative examples include fluorochemical agent in a bath having the same items as the conventional bath. In one example the fluorochemical agent is anionic and is of the formula $C_{10}F_{21}SO_3NH_4$ (25% solution in butyl cellosolve/-water (37.5/37.5)) and is present in an amount of 0.18 gram per liter.

In another example the fluorochemical agent is anionic and is of the formula $$C_8F_{17}SO_2\underset{\underset{C_2H_5}{|}}{N}-CH_2COOK$$ (50% solution in butyl cellosolve/ethanol/water (14:4:32))

and is present in an amount of 0.14 gram per liter.

The fluorochemical agents were added to the conventional surfactant before being added to the respective soak baths.

After the overnight soaking the pelts which were soaked in the baths containing the fluorochemical agents were more open than those which had been soaked in the conventional bath.

EXAMPLE 3

Wool-on sheepskin pelts are subjected to bating and pickling. The bating relies upon enzymes to break down miscellaneous proteins in the pelts. The pickling involves the use of acid to lower the pH of the pelts.

The control bath contains one kilogram of pelts for each 20 kilograms of water (at 35° C.). To the bath there is added sodium chloride (20 grams per liter) and a first enzyme (3.3 grams per liter), after which the bath is stirred for 60 minutes. Then a second enzyme is added (3.0 grams per liter) after which the bath is stirred for 3 hours. Then sodium chloride (38 grams per liter) is added and the bath is stirred for fifteen minutes. Then formic acid (4.3 grams per liter) and sulfuric acid (0.4 gram per liter) are added, after which the bath is stirred for 3 hours. Then the bath is drained and the pelts remain for several days.

In separate examples separate fluorochemicals are diluted and then mixed with the first enzyme and added to the bath. The concentration of the fluorochemical in each respective bath is 0.17 gram per liter. The separate fluorochemicals used were of the formulas:

A. $C_8F_{17}SO_2NHCH_2CH_2CH_2N^+(CH_3)_3I^-$ (50% solution is isopropyl alcohol/water (33/17)) cationic B. $C_7F_{15}COONH_4$ anionic C. $C_8F_{17}SO_2NHCH_2CH_2CH_2N^+(CH_3)_3Cl^-$ (40% solution in isopropyl alcohol/water (28/22)) cationic Each fluorochemical agent was diluted (1:10) in water and then added to the first enzyme (and then to the bath) for each respective example.

More efficient bating is observed when using the fluorochemical of formula A. Pelts which were treated in the manner described above and then finished in the normal procedure (i.e., tanned, dyed, etc.) exhibited increased surface area (about 4%) over pelts processed entirely in the conventional manner.

EXAMPLE 4

Wool-on sheepskin pelts are degreased to remove natural animal fat. The conventional first bath includes water (35° C.), 1 kilogram of pelts per 10 kilograms of water, sodium chloride (74 grams per liter), degreasing agent (35 grams per liter), and ethylene oxide (3.7 grams per liter). The bath is stirred for 90 minutes, then it is drained and the pelts rinsed.

The conventional second bath includes water (35° C.), pelts, sodium chloride (74 grams per liter), ethylene oxide (1.8 grams per liter), and conventional surfactant (0.25 grams per liter). The bath is stirred for 60 minutes, then it is drained and the pelts are rinsed.

Comparative examples were run using a fluorochemical agent as an additive, at two different concentrations, to the conventional bath. The fluorochemical used was an oligomeric nonionic copolymer of $$C_8F_{17}SO_2\underset{\underset{C_4H_9}{|}}{N}C_2H_4OCOCH{=}CH_2$$

and acrylic acid ester (about 60% esterified) of $HO(C_2H_4O)_{10}(C_3H_6O)_{22}(C_2H_4O)_{10}H$ at a ratio of 30:70.

The fluorochemical was diluted (1:10) in water and added to the mixture of degreasing agent and ethylene oxide in the first bath and to ethylene oxide in the second bath. It was used at a concentration of 0.5 gram per liter in the first bath and 0.25 gram per liter in the second bath.

The pelts were clearly less fatty and lighter after being treated in the baths containing the fluorochemical. The decrease in weight was about 4.5% as compared to conventional processing. Finished leathers exhibited superior quality (shade, hand, softness, etc.) as compared to conventional processing.

EXAMPLE 5

Wool-on sheepskin pelts are tanned and processed in a conventional bath containing water (30° C.) and pelts (1 kilogram per 10 kilograms of water) to which is then added sodium chloride (80 grams per liter), and formic acid. The bath is stirred for 10 minutes. Then conventional surfactants (1.5 grams per liter) are added, followed by stirring for 10 minutes. Then sodium acetate (0.8 gram per liter) and aluminum salts (4.5 grams per liter) are added, followed by stirring for 30 minutes. Then chromium salts (23 grams per liter) are added, after which the bath is stirred for 15 minutes. Then fatliquor is added (19 grams per liter), after which the bath is stirred for 3 hours and then left overnight.

In comparative examples three separate fluorochemicals were used in separate samples of the bath. The fluorochemicals used were of the formulas A, B and C as described in Example 3. Each fluorochemical composition was used at a concentration of 0.4 gram per liter and was diluted 1:10 in water and then added with the formic acid to the bath.

The inclusion of each of these fluorochemical compositions resulted in a slightly more exhausted bath at the end of the process and a higher pH for the leather. These are very desirable advantages.

EXAMPLE 6

Wool-on sheepskin pelts which have been tanned are subjected to neutralizing and fatliquoring. In the conventional neutralizing bath the water is at 40° C. and contains pelts (1 kilogram per 10 kilograms), sodium formate (2 grams per liter) and sodium bicarbonate (8 grams per liter). The bath is stirred for 2 hours, then drained, after which the pelts are rinsed.

For conventional fatliquoring, the water is at 40° C. and the fatliquors are present at 24 grams per liter. The bath is stirred for two hours, then drained, after which the pelts are rinsed.

In separate examples various fluorochemical compositions are added to the conventional neutralizing bath (along with the sodium formate) and to the conventional fatliquor bath (along with the fatliquors). The fluorochemical compositions used, and the amounts added, are as follows:

| | Amount Added |
|---|---|
| $C_8F_{17}SO_3K$ | 0.4 gram/liter |
| $C_6F_{13}SO_2N$ (with $CH_2CH(OH)CH_2SO_3^-$ and $CH_2CH_2CH_2N^+(CH_3)_2CH_2CH_2OH$) (25% solution in butyl carbitol/water (25/50)) | 0.5 g/l |
| $C_{10}F_{21}SO_3NH_4$ (25% solution in butyl cellosolve/water 37.5/37.5)) | 0.5 g/l |
| $C_8F_{17}SO_2N(C_2H_5)CH_2COOK$ (50% solution in butyl cellosolve/ethanol/water) (14/4/32) | 0.4 g/l |
| $C_7F_{15}COONH_4$ | 0.4 g/l |
| $C_8F_{17}SO_2N(C_2H_5)C_2H_4(OC_2H_4)_{13}OH$ (95% solution in water) | 0.3 g/l |
| Fluorochemical agent from Example 4 | 0.6 g/l |

In all examples the presence of the fluorochemical composition resulted in a higher pH throughout the leather. Also, the leathers performed better in the mechanical works (stretching, buffing, etc.) believed to be due to deeper penetration of the fatliquors. Increased surface area of about 6% or more was observed as compared to leather obtained from conventional processing. The leather also exhibited better water retention and faster than usual drying time. Finished leather also exhibited slightly higher quality than obtained using conventional processing.

EXAMPLE 7

Wool-on sheepskin pelts are dyed in a conventional dye bath containing water at 20° C., pelts (1 kilogram per 10 kilograms of water), leveller (0.5 gram/liter), ammonia (2 grams per liter), dyestuff (about 1.5-3.0 grams per liter, depending upon specific color used), and formic acid (2 grams per liter). Before the dyestuff is added, the bath is stirred for 15 minutes. After the dyestuff is added, the bath is stirred for 60 minutes. After the formic acid is added the bath is 15 stirred for 60 minutes, then drained, and the pelts are washed.

Two separate experiments were run involving the addition of the following fluorochemical composition to the bath.

| | |
|---|---|
| $C_8F_{17}SO_2N(C_2H_5)-CH_2COOK$ | (50% solution in butyl cellosolve/ethanol/water (14:4:32) |

In the first experiment the fluorochemical composition is added (0.3 gram/liter) to the dyestuff and premixed and then added to the bath. The dyestuff was present in an amount of 1.8 gram/liter in the final bath composition. The wool sheepskin was then dyed. The fluorochemical did not interfere with the dyeing process.

In another experiment the fluorochemical composition was added in an amount of 0.4 gram per liter and the dyestuff was present in the final bath at a concentration of 2.9 grams per liter Previously dyed wool sheepskin was treated in the bath. The fluorochemical did not interfere with the dyeing process.

In a dyeing/fixation experiment, leathers with 1.8 grams per liter dyestuff, undyed wool, were treated with 0.2 gram per liter of cationic fluorochemical composition $C_8F_{17}SO_2NHCH_2CH_2CH_2N^+(CH_3)_3I^-$, a 50% solution in isopropyl alcohol (33) and water (17). The fluorochemical composition was added to the formic acid and then added to the dye bath shown above.

In another dyeing/fixation experiment the fluorochemical composition was used in an amount of 0.3 gram per liter and the leather treated was that which previously had been dyed with 2.9 grams per liter dyestuff.

In the fixation experiments just described, the baths were exhausted in half the time required for the control baths. No significant difference in shade of finished leathers was observed, as compared to the controls.

Other variants are possible without departing from the scope of the present invention.

What is claimed is:

1. A process for manufacturing leather from animal hide using processing baths of aqueous treating compositions comprising the steps of hydrating, bating, pickling, degreasing, and tanning, at least one said bath containing a small amount of at least 0.001% by weight of an anionic, cationic, nonionic or amphoteric fluorochemical processing aid which contains one or more fluorinated aliphatic radicals, $R_f$, which provide at least 10 percent by weight fluorine to said processing aid and one or more water-solubilizing groups in at least one of said steps, said processing aid being represented by the formula $$(R_f)_nQ_aZ$$

wherein $R_f$ is a saturated, monovalent, non-aromatic, fluoroaliphatic radical having at least three carbon atoms and not more than about 20 carbon atoms with the proviso that if hydrogen or chlorine atoms are present as substituents, not more than one atom of hydrogen or chlorine is present for every two carbon atoms; Q is alkylene, arylene, sulfonamidoalkylene, carbonamidoalkylene, or siloxane; Z is a water-solubilizing polar group selected from the group consisting of $CO_2H$, $CO_2M$, $SO_3H$, $SO_3M$, $OSO_3H$, $OSO_3M$, $OPO(OM)_2$, where M is a metallic ion, an ammonium ion, $NH_2$, NHR, $NR_2$, $NR_2O$ where R is a lower alkyl group, $NR'_3A']$where R' is a lower alkyl group or hydrogen and A' is chloride, sulfate, phosphate or hydroxyl, or poly(oxyalkylene); a is zero or 1; and n is 1 or 2 or said processing aid is a fluorochemical oligomer containing 3 to 30 monomer units and having a plurality of pendant fluoroaliphatic groups, $R_f$, linked to water-solubilizing poly(oxyalkylene) moieties.

2. The process of claim 1 wherein said treating agent is represented by the formula $$(R_f)_mQ'[(R'')_xQ''Y]_p \text{ or}$$

$$[(R_f)_mQ'[(R'')_xQ''Y']_p]_t$$

wherein $R_f$ is a saturated, monovalent, non-aromatic, fluoroaliphatic radical having at least three carbon atoms and not more than about 20 carbon atoms with the proviso that if hydrogen or chlorine atoms are present as substituents, not more than one atom of hydrogen or chlorine is present for every two carbon atoms; Q' is a linkage through which $R_f$ and R'' are covalently bonded together; R'' is an oxyalkylene group selected from $—OC_2H_4—$and $—OC_3H_6$ radicals; Y is a monovalent terminal organic radical; Y' is Y or a valence bond, with the proviso that at least one Y' is a valence bond interconnecting a Q'-bonded R'' radical to another Q'; Q'' is a linkage through which Y or Y' and R'' are covalently bonded together; m is a number of at least 2; x is a number of at least 5; p is a number of at least 2; and t is a number of 2 or higher.

3. A process for soaking an animal hide in an aqueous solution to rehydrate said hide, the improvement comprising the step of including a small amount of at least 0.001% by weight of an anionic, cationic, nonionic or amphoteric fluorochemical processing aid which contains one or more fluorinated aliphatic radicals which provide at least 10 percent by weight fluorine to said processing aid and one or more water-solubilizing groups, said processing aid being represented by the formula $$(R_f)_nQ_aZ$$

wherein $R_f$ is a saturated, monovalent, non-aromatic, fluoroaliphatic radical having at least three carbon atoms and not more than about 20 carbon atoms with the proviso that is hydrogen or chlorine atoms are present as substituents, not more than one atom of hydrogen or chlorine is present for every two carbon atoms; Q is alkylene, arylene, sulfonamidoalkylene, carbonamidoalkylene, or siloxane; Z is a water-solubilizing polar group selected from the group consisting of $CO_2H$, $CO_2M$, $SO_3H$, $SO_3M$, $OSO_3M$, $OSO_3M$, $OPO(OM)_2$, where M is a metallic ion, an ammonium ion, $NH_2$, NHR, $NR_2$, $NR_2O$ where R is a lower alkyl group, $NR'_3A'$ where R' is a lower alkyl group or hydrogen and A' is chloride, sulfate, phosphate or hydroxyl, or poly(oxyalkylene); a is zero or 1; n is 1 or 2; or said processing aid is a fluorochemical oligomer containing from 3 to 30 monomer units and having a plurality of pendant fluoroaliphatic groups, $R_f$, linked to water-solubilizing poly(oxyalkylene) moieties.

4. A process for bating a hide, the improvement comprising treating said hide with an aqueous composition comprising an enzyme and a small amount of at least 0.001% by weight of an anionic, cationic, nonionic or amphoteric fluorochemical processing aid which contains one or more fluorinated aliphatic radicals which provide at least 10 percent by weight fluorine to said processing aid and one or more water-solubilizing groups, said processing aid being represented by the formula $$(R_f)_nQ_aZ$$

wherein $R_f$ is a saturated, nomovalent, non-aromatic, fluoroaliphatic radical having at least three carbon atoms and not more than about 20 carbon atoms with the proviso that if hydrogen or chlorine atoms are present as substituents, not more than one atom of hydrogen or chlorine is present for every two carbon atoms; Q is alkylene, arylene, sulfonamidoalkylene, carbonamidoalkylene, or siloxane; Z is a water-solubilizing polar group selected from the group consisting of $CO_2H$, $CO_2M$, $SO_3H$, $SO_3M$, $OSO_3H$, $OSO_3M$, $OPO(OM)_2$, where M is a metallic ion, an ammonium ion, $NH_2$, NHR, $NR_2$, $NR_2O$ where R is a lower alkyl group, $NR'_3A'$ where R' is a lower alkyl group or hydrogen and A' is chloride, sulfate, phosphate or hydroxyl, or poly(oxyalkylene); a is zero or 1; n is 1 or 2; or said processing aid is a fluorochemical oligomer containing 3 to 30 monomer units and having a plurality of pendant fluoroaliphatic groups, $R_f$, linked to water-solubilizing poly(oxyalkylene) moieties.

5. A process for pickling a hide, the improvement comprising treating said hide with an aqueous composition comprising an acid and a small amount of at least 0.001% by weight of an anionic, cationic, nonionic or amphoteric fluorochemical processing aid which contains one or more fluorinated aliphatic radicals which provide at least 10 percent by weight fluorine to said processing aid and one or more water-solubilizing groups, said processing aid being represented by the formula $$(R_f)_aQ_nZ$$

wherein $R_f$ is a saturated, monovalent, non-aromatic, fluoroaliphatic radical having at least three carbon atoms and not more than about 20 carbon atoms with the proviso that if hydrogen or chlorine atoms are present as substituents, not more than one atom of hydrogen or chlorine is present for every two carbon atoms; Q is alkylene, arylene, sulfonamidoalkylene, carbonamidoalkylene, or siloxane; Z is a water-solubilizing polar group selected from the group consisting of $CO_2H$, $CO_3M$, $SO_3H$, $SO_3M$, $OSO_3H$, $OSO_3M$, $OPO(OM)_2$, where M is a metallic ion, an ammonium ion, $NH_2$, NHR, $NR_2$, $NR_2O$ where R is a lower alkyl group, $NR'_3A'$ where R' is a lower alkyl group or hydrogen and A' is chloride, sulfate, phosphate or hydroxyl, or poly(oxyalkylene); a is zero or 1; n is 1 or 2; or said processing aid is a fluorochemical oligomer containing 3 to 30 monomer units and having a plurality of pendant fluoroaliphatic groups, $R_f$, linked to water-solubilizing poly(oxyalkylene) moieties.

6. A process for degreasing a hide, the improvement comprising treating said hide with an aqueous composition comprising a degreasing agent and a small amount of at least 0.001% by weight of an anionic, cationic, nonionic or amphoteric fluorochemical processing aid which contains one or more fluorinated aliphatic radicals which provide at least 10 percent by weight fluorine to said processing aid and one or more water-solubilizing groups, said processing aid being represented by the formula $$(R_f)_nQ_aZ$$

wherein $R_f$ is a saturated, nomovalent, non-aromatic, fluoroaliphatic radical having at least three carbon atoms and not more than about 20 carbon atoms with the proviso that if hydrogen or chlorine atoms are present as substituents, not more than one atom of hydrogen or chlorine is present for every two carbon atoms; Q is alkylene, arylene, sulfonamidoalkylene, carbonamidoalkylene, or siloxane; Z is a water-solubilizing polar group selected from the group consisting of $CO_2H$, $CO_2M$, $SO_3H$, $SO_3M$, $OSO_3H$, $OSO_3M$, $OPO(OM)_2$, where M is a metallic ion, an ammonium ion, $NH_2$, NHR, $NR_2$, $NR_2O$ where R is a lower alkyl group, $NR'_3A'$ where R' is a lower alkyl group or hydrogen and A' is chloride, sulfate, phosphate or hydroxyl, or poly(oxyalkylene); a is zero or 1; n is 1 or 2; or said processing aid is a fluorochemical oligomer containing from 3 to 30 monomer units and having a plurality of pendant fluoroaliphatic groups, $R_f$, linked to water-solubilizing poly(oxyalkylene) moieties.

7. A process for tanning a hide the improvement comprising treating said hide with an aqueous composition comprising a tanning agent and a small amount of at least 0.001% by weight of an anionic, cationic, nonionic or amphoteric fluorochemical processing aid which contains one or more fluorinated aliphatic radicals which provide at least 10 percent by weight fluorine to said processing said and one or more water-solubilizing groups, said processing aid being represented by the formula $$(R_f)_nQ_aZ$$

wherein $R_f$ is a saturated, monovalent, non-aromatic, fluoroaliphatic radical having at least three carbon atoms and not more than about 20 carbon atoms with the proviso that is hydrogen or chlorine atoms are present as substituents, not more than one atom of hydrogen or chlorine is present for every two carbon atoms; Q is alkylene, arylene, sulfonamidoalkylene, carbonamidoalkylene, or siloxane; Z is a water-solubilizing polar group selected from the group consisting of $CO_2H$, $CO_2M$, $SO_3H$, $SO_3M$, $OSO_3H$, $OSO_3M$, $OPO(OM)_2$, where M is a metallic ion, an ammonium ion, $NH_2$, NHR, $NR_2$, $NR_2O$ where R is a lower alkyl group, $NR'_3A'$ where R' is a lower alkyl group or hydrogen and A' is chloride, sulfate, phosphate or hydroxyl, or poly(oxyalkylene); a is zero or 1; n is 1 or 2; or said processing aid is a fluorochemical oligomer containing from 3to 30 monomer units and having a plurality of pendant fluoroaliphatic groups, $R_f$, linked to water-solubilizing poly(oxyalkylene) moieties.

8. A process for fatliquoring a hide, the improvement comprising treating said hide with an aqueous composition comprising a fatliquoring agent and at least 0.001% by weight of an anionic, cationic, nonionic or amphoteric fluorochemical processing aid which contains one or more fluorinated aliphatic radicals which provide at least 10 percent by weight fluorine to said processing aid and one or more water-solubilizing groups in at least one of said steps, said processing aid being represented by the formula $$(R_f)_nQ_aZ$$

wherein $R_f$ is a saturated, monovalent, non-aromatic, fluoroaliphatic radical having at least three carbon atoms and not more than about 20 carbon atoms with the proviso that if hydrogen or chlorine atoms are present as substituents, not more than one atom of hydrogen or chlorine is present for every two carbon atoms; Q is an alkylene, arylene, sulfonamidoalkylene, carbonamidoalkylene, or siloxane linking group or combinations thereof; Z is a water-solubilizing polar group selected from the group consisting of $CO_2H$, $CO_2M$, $SO_3H$, $SO_3M$, $OSO_3H$, $OSO_3M$, $OPO(OM)_2$, where M is a metallic ion, an ammonium ion, $NH_2$, NHR, $NR_2$, $NR_2O$ where R is a lower alkyl group, $NR'_3A'$ where R' is a lower alkyl group or hydrogen and A' is chloride, sulfate, phosphate or hydroxyl, or poly(oxyalkylene); a is zero or 1; n is 1 or 2; or said processing aid is a fluorochemical oligomer containing 3 to 30 monomer units and having a plurality of pendant fluoroaliphatic groups, $R_f$, linked to water-solubilizing poly(oxyalkylene) moieties.

9. A process for fixation of a dye in a hide, the improvement comprising treating said hide with an aqueous composition comprising an acid and at least 0.001% by weight of an anionic, cationic, nonionic or amphoteric fluorochemical processing aid which contains one or more fluorinated aliphatic radicals which provide at least 10 percent by weight fluorine to said processing aid and one or more water-solubilizing groups in at least one of said steps, said processing aid being represented by the formula $$(R_f)_nQ_aZ$$

wherein $R_f$ is a saturated, monovalent, non-aromatic, fluoroaliphatic radical having at least three carbon atoms and not more than about 20 carbon atoms with the proviso that if hydrogen or chlorine atoms are present as substituents, not more than one atom of hydrogen or chlorine is present for every two carbon atoms; Q is an alkylene, arylene, sulfonamidoalkylene, carbonamidoalkylene, or siloxane linking group or combinations thereof; Z is a water-solubilizing polar group selected from the group consisting of $CO_2H$, $CO_2M$, $SO_3H$, $SO_3M$, $OSO_3H$, $OSO_3M$, $OPO(OM)_2$, where M is a metallic ion, an ammonium ion, $NH_2$, NHR, $NR_2$, $NR_2O$ where R is a lower alkyl group, $NR'_3A'$ where R' is a lower alkyl group or hydrogen and A' is chloride, sulfate, phosphate or hydroxyl, or poly(oxyalkylene); a is zero or 1; n is 1 or 2; or said processing aid is a fluorochemical oligomer containing 3 to 30 monomer units and having a plurality of pendant fluoroaliphatic groups, $R_f$, linked to water-solubilizing poly(oxyalkylene) moieties.

10. A process comprising neutralizing, fatliquoring, or dyeing a hide in an aqueous treating bath, the improvement being the bath comprising at least 0.001% by weight of an anionic, cationic, nonionic or amphoteric fluorochemical processing aid which contains one or more fluorinated aliphatic radicals which provide at least 10 percent by weight fluorine to said processing aid and one or more water-solubilizing groups in at least one of said steps, said processing aid being represented by the formula $$(R_f)_nQ_zZ$$

wherein $R_f$ is a saturated, monovalent, non-aromatic, fluoroaliphatic radical having at least three carbon atoms and not more than about 20 carbon atoms with the proviso that if hydrogen or chlorine atoms are present as substituents, not more than one atom of hydrogen or chlorine is present for every two carbon atoms; Q is an alkylene, arylene, sulfonamidoalkylene, carbonamidoalkylene, or siloxane linking group or combinations thereof; Z is a water-solubilizing polar group selected from the group consisting of $CO_2H$, $CO_2M$, $SO_3H$, $SO_3M$, $OSO_3H$, $OSO_3M$, $OPO(OM)_2$, where M is a metallic ion, an ammonium ion, $NH_2$, NHR, $NR_2NR_2O$ where R is a lower alkyl group, $NR'_3A'$ where R' is a lower alkyl group or hydrogen and A' is chloride, sulfate, phosphate or hydroxyl, or poly(oxyalkylene); a is zero or 1; n is 1 or 2; or said processing aid is a fluorochemical oligomer having a plurality of pendant fluoroaliphatic groups, $R_f$, linked to water-solubilizing poly(oxyalkylene) moieties.

11. Leather produced in accordance with the process of claim 10.

12. Leather produced in accordance with the process of claim 10.

* * * * *

UNITED STATES PATENT AND TRADEMARK OFFICE

CERTIFICATE OF CORRECTION

PATENT NO. : 5,098,446

DATED : March 24, 1992

INVENTOR(S) : L. Miguel Blanco-Rodriguez and Claudio M. Martinez

It is certified that error appears in the above-indentified patent and that said Letters Patent is hereby corrected as shown below:

On the title page, under item [19], change "Rodriguez" to --Blanco-Rodriguez-- and item [75], change "L.M.B. Rodriguez-- to --L. Miguel Blanco-Rodriguez--

| | |
|---|---|
| [75] Inventors: | "L.M.B. Rodriguez," should be -- L. Miguel Blanco-Rodriguez -- |
| Col. 4, line 10 | delete "a is zero or" |
| Col. 4, line 68 and Col. 5, line 1 | "$C_8F_{17}C_2H_4SCHCO_2(C_3H_6O)_mH$ $CH_2CO_2(C_3H_6O)_nH$ (m+n=20)" should read -- $C_8F_{17}C_2H_4SCH(CO_2(C_3H_6O)_mH)CH_2CO_2(C_3H_6O)_nH$ (m+n=20) -- |
| Col. 5, line 11 | "$C_6F_{13}SO_2N(CH_2CH_2OH)C_3H_5N^+(CH_3)_2C_2H_4OH$" should read -- $C_6F_{13}SO_2N(CH_2CH_2OH)C_3H_6N^+(CH_3)_2C_2H_4OH$ -- |
| Col. 9, line 64 | "in" should read -- is -- |
| Col. 11, line 64 | delete "I5" |
| Col. 12, line 67 | delete "]" |
| Col. 13, line 51 | delete "$OSO_3M$" (first occurrance) and insert -- $OSO_3H$ -- |
| Col. 14, line 36 | "$(R_f)_aQ_nZ$" should read -- $(R_f)_nQ_aZ$ -- |
| Col. 15, line 1 | "nomovalent" should read -- monovalent -- |

UNITED STATES PATENT AND TRADEMARK OFFICE

CERTIFICATE OF CORRECTION

PATENT NO. : 5,098,446

DATED : March 24, 1992

INVENTOR(S) : L. Miguel Blanco-Rodriguez and Claudio M. Martinez

It is certified that error appears in the above-indentified patent and that said Letters Patent is hereby corrected as shown below:

Col. 15, line 28 "said" should be -- aid --

Col. 15, line 50 "3to" should read -- 3 to --

Col. 16, line 62 "$(R_f)_nQ_zZ$" should read -- $(R_f)_nQ_aZ$

Col. 18, line 6 "10" should read -- 1 --

Col. 12, line 64 before "$CO_2H$,",
Col. 13, line 51 before "$CO_2H$,",
Col. 14, line 15 before "$CO_2H$,",
Col. 14, line 47 before "$CO_2H$,",
Col. 15, line 11 before "$CO_2H$,",
Col. 15, line 43 before "$CO_2H$,",
Col. 16, line 6, before "$CO_2H$,",
Col. 16, line 39 before "$CO_2H$,",
Col. 17, line 5 before "$CO_2H$,".

insert --anionic, cationic, non-ionic and combinations thereof, wherein said anionic group is selected from the group consisting of--

Col. 12, lines 64-65, before "$OPO(OM)_2$",
Col. 13, lines 51-52, before "$OPO(OM)_2$",
Col. 14, lines 15-16, before "$OPO(OM)_2$",
Col. 14, lines 47-48, before "$OPO(OM)_2$",
Col. 15, lines 11-12, before "$OPO(OM)_2$",
Col. 15, lines 43-44, before "$OPO(OM)_2$",
Col. 16, line 7, before "$OPO(OM)_2$",
Col. 16, line 40, before "$OPO(OM)_2$",
Col. 17, line 6, before "$OPO(OM)_2$".

insert -- $OPO(OH)_2$ --

UNITED STATES PATENT AND TRADEMARK OFFICE

CERTIFICATE OF CORRECTION

PATENT NO. : 5,098,446

DATED : March 24, 1992

INVENTOR(S) : L. Miguel Blanco-Rodriguez and Claudio M. Martinez

It is certified that error appears in the above-indentified patent and that said Letters Patent is hereby corrected as shown below:

Col. 12, line 66, before "$NH_2$,",
Col. 13, line 53, before "$NH_2$,",
Col. 14, line 17, before "$NH_2$,",
Col. 14, line 49, before "$NH_2$,",
Col. 15, line 13, before "$NH_2$,",
Col. 15, line 45, before "$NH_2$,",
Col. 16, line 8, before "$NH_2$,",
Col. 16, line 41, before "$NH_2$,",
Col. 17, line 7, before "$NH_2$,".

insert -- or other amine cation, and said cationic group is selected from the group consisting of --

Col. 12, line 66, after "$NR_2$,",
Col. 13, line 53, after "$NR_2$,",
Col. 14, line 17, after "$NR_2$,",
Col. 14, line 49, after "$NR_2$,",
Col. 15, line 13, after "$NR_2$,",
Col. 15, line 45, after "$NR_2$,",
Col. 16, line 9, after "$NR_2$,",
Col. 16, line 42, after "$NR_2$,", delete "$NR_2O$"

Col. 17, line 8, "$NR_2NR_2O$" should read -- $NR_2$ --

UNITED STATES PATENT AND TRADEMARK OFFICE

CERTIFICATE OF CORRECTION

PATENT NO. : 5,098,446

DATED : March 24, 1992

INVENTOR(S) : L. Miguel Blanco-Rodriguez and Claudio M. Martinez

It is certified that error appears in the above-indentified patent and that said Letters Patent is hereby corrected as shown below:

| | |
|---|---|
| Col. 13, line 1, | After "hydroxyl," delete |
| Col. 13, lines 55-56, | "or poly(oxyalkylene);" and insert |
| Col. 14, lines 19-20, | -- and said non-ionic group is |
| Col. 14, lines 51-52, | selected from the group consisting |
| Col. 15, lines 15-16, | of $NR_2 \rightarrow O$, where R is a lower alkyl |
| Col. 15, lines 47-48, | group, and poly(oxyalkylene) |
| Col. 16, line 11, | moieties; -- |
| Col. 16, line 44, | |
| Col. 17, line 10 and Col. 18, line 1., | |

Signed and Sealed this

Seventeenth Day of January, 1995

Bruce Lehman

*Attest:*

BRUCE LEHMAN

*Attesting Officer*

*Commissioner of Patents and Trademarks*